US011655135B2

(12) United States Patent
Szeteli et al.

(10) Patent No.: US 11,655,135 B2
(45) Date of Patent: May 23, 2023

(54) TUBE FOR A WITHDRAWAL SYSTEM AND METHOD FOR WITHDRAWING A FLUID FROM A CONTAINER VIA A WITHDRAWAL SYSTEM

(71) Applicant: AS Strömungstechnik GmbH, Ostfildern (DE)

(72) Inventors: Andreas Szeteli, Filderstadt (DE); Nico Fischer, Filderstadt (DE)

(73) Assignee: AS Strömungstechnik GmbH, Ostfildern (DE)

( * ) Notice: Subject to any disclaimer, the term of this patent is extended or adjusted under 35 U.S.C. 154(b) by 0 days.

(21) Appl. No.: 17/130,104

(22) Filed: Dec. 22, 2020

(65) Prior Publication Data

US 2021/0253413 A1 Aug. 19, 2021

(30) Foreign Application Priority Data

Feb. 18, 2020 (EP) ..... 20158022

(51) Int. Cl.
*B67D 1/08* (2006.01)
*B67D 1/00* (2006.01)

(52) U.S. Cl.
CPC ..... *B67D 1/0848* (2013.01); *B67D 1/0004* (2013.01); *B67D 1/0801* (2013.01); *B67D 1/0835* (2013.01); *B67D 2001/0812* (2013.01)

(58) Field of Classification Search
CPC .. B67D 1/0848; B67D 1/0004; B67D 1/0801; B67D 1/0835; B67D 2001/0812; B67D 7/0294; B67D 1/0832; F16L 37/22
See application file for complete search history.

(56) References Cited

U.S. PATENT DOCUMENTS 1,613,821 A * 1/1927 Frawley ..... F16N 3/08 222/382
2,055,045 A * 9/1936 Paull ..... F16N 3/08 222/382
2,315,263 A * 3/1943 Lindsay ..... A62C 13/003 169/72
3,039,656 A * 6/1962 Wentz ..... B67D 1/1466 222/173
3,339,811 A * 9/1967 Haag ..... B67D 1/0802 222/394
3,423,110 A * 1/1969 Hansen ..... F16L 37/22 285/277
3,578,219 A * 5/1971 Berry ..... B67D 1/0835 222/394
3,709,528 A * 1/1973 Cruse ..... F16L 37/42 285/330
4,995,534 A * 2/1991 Norman ..... B67D 1/1466 222/394
5,836,364 A * 11/1998 Burton ..... B67D 1/0456 141/2

(Continued)

FOREIGN PATENT DOCUMENTS

DE 102010049024 A1 4/2012
EP 2848583 B1 3/2015

(Continued)

*Primary Examiner* — Donnell A Long
(74) *Attorney, Agent, or Firm* — Michael Soderman

(57) ABSTRACT

A removal system (1) with an interface 5*a* for releasable connection to an extraction head (2) of the removal system (1), such that the tube (5) can be used as a single-use part for removing fluid from a container.

4 Claims, 7 Drawing Sheets

(56) References Cited

U.S. PATENT DOCUMENTS

| | | | | |
|---|---|---|---|---|
| 6,568,717 | B1 * | 5/2003 | Le Clinche | F16L 37/23 403/322.2 |
| 2003/0038147 | A1 * | 2/2003 | Rauworth | B67D 7/0288 222/464.1 |
| 2006/0226175 | A1 * | 10/2006 | Sledzieski | F16L 33/30 222/382 |
| 2010/0230433 | A1 * | 9/2010 | Kreyenberg | B67D 1/0418 222/394 |
| 2013/0056504 | A1 * | 3/2013 | Otto | B67D 1/0801 222/545 |
| 2015/0314316 | A1 * | 11/2015 | Kusz | B05B 15/30 222/105 |
| 2018/0209566 | A1 * | 7/2018 | Szeteli | B67D 7/0294 |
| 2018/0297830 | A1 * | 10/2018 | Kraenzle | B67D 1/0807 |
| 2021/0229976 | A1 * | 7/2021 | Petrangeli | B65D 47/248 |

FOREIGN PATENT DOCUMENTS

| | | | | |
|---|---|---|---|---|
| WO | 2006000437 | A1 | 1/2006 | |
| WO | WO-2007061967 | A2 * | 5/2007 | B67D 7/0272 |
| WO | WO-2008150235 | A1 * | 12/2008 | B65D 41/16 |
| WO | 2011100937 | A1 | 8/2011 | |
| WO | WO-2015022692 | A2 * | 2/2015 | B67D 1/0021 |

* cited by examiner

TUBE FOR A WITHDRAWAL SYSTEM AND METHOD FOR WITHDRAWING A FLUID FROM A CONTAINER VIA A WITHDRAWAL SYSTEM

CROSS REFERENCE TO RELATED APPLICATIONS

This application claims the priority of EP 20158022.2 filed on 2020 Feb. 18; this application is incorporated by reference herein in its entirety.

BACKGROUND

The invention concerns a tube for a removal system and a method for removing fluid from a container by means of a removal system.

Such removal systems comprise bottles in which fluids, such as chemicals, are stored, as well as extraction heads that may be fastened to the openings of the bottles, wherein the extraction heads have closing means suitable for this purpose. Such bottles are used in laboratories, for example.

In known removal systems of this type, the extraction head is designed in the form of a simple lid, into which a tube is placed and guided into the internal cavity of the associated bottle. The tube is then connected to a pump in order to pump fluid out of the container.

Once the bottle is emptied, the tube is pulled out of the lid and may be used for removing fluid from another bottle.

Alternatively, the tube can also remain fed through the lid during the exchange. The lid is then fastened to a new bottle.

A first disadvantage of such a removal system consists in that the bore hole in the lid, through which hole the tube is fed, does not form a leak-tight seal. Therefore, vapors of the fluid stored in the bottle may escape, which is especially serious when toxic chemicals are stored in the bottle.

Another disadvantage is that the tube pulled out of the empty bottle contaminates the fluid in the next bottle into which it is introduced, since fluid residues of the fluid in the first bottle still adhere to it.

Moreover, when pulling out the tube, an operator may be exposed to fluid residues insofar as fluid residues continue to drip out of the tube.

From EP 2 848 583 B1, a removal system is known in which an extraction head with a dip tube may be fastened in a container opening of a container. Fluid may be removed from the container via the dip tube.

Such removal systems working with dip tubes may only be used for larger containers, such as barrels, but not for removal of fluids from bottles.

For use of the removal system for bottles, structural changes would have to be made that would impair the transport approval required for removal of fluids from the bottles.

SUMMARY

The invention concerns a tube for a removal system (1) with an interface 5*a* for releasable connection to an extraction head (2) of the removal system (1), such that the tube (5) can be used as a single-use part for removing fluid from a container.

DETAILED DESCRIPTION

The invention seeks to solve the problem of designing a removal system of the type mentioned initially such that it has high functionality yet a simple design structure.

The features of independent claims are intended to solve this problem. Advantageous embodiments and useful further developments of the invention are described in the dependent claims.

The invention concerns a tube for a removal system with an interface for releasable connection to an extraction head of the removal system, such that the tube can be used as a single-use part for removal of fluid from a container.

The basic idea behind the invention therefore consists in designing the tube for removing fluid from a container, or also for filling the container, as a single-use part, i.e. a disposable part.

The tube has a suitable interface for this purpose, by means of which the tube can be releasably connected to the extraction head of a removal system.

To remove fluid, the tube is connected to the extraction head and the extraction head is fastened to the container using a closing means as a component of the extraction head. After removing fluid, the tube is disconnected from the extraction head and can be disposed of with the bottle. In principle, the removal system according to the invention is also suitable for filling containers.

The tube according to the invention along with the removal system can be used for different containers. It is especially advantageous for the containers to be bottles or canisters, which are referred to below, without restricting from applicability to containers in general.

The tube along with the interface forms a low-cost, efficiently producible unit that can be used as a modular unit within a removal system.

It is especially advantageous for the interface to be designed for connection to different extraction heads.

The tube with its interface therefore forms a modular unit that can be flexibly employed and used for a wide range of applications due to the possibility of connecting to different removal systems.

It is further advantageous for the interface to be made of a plastic part fastened to the tube.

The interface can therefore be produced at low-cost and efficiently in the form of an injection molded plastic part.

Moreover, the invention concerns a method for removing fluid from a container by means of a removal system.

An essential advantage of the invention is therefore that, with the tube as a disposable part which is releasably fastened on the extraction head, contamination may be easily avoided during multiple use of the extraction head. The tube fastened to the extraction head is only used once to empty a bottle and is then left in this bottle by operating the actuation mechanism on the extraction head. This prevents the tube from contaminating the fluid in the bottle that is emptied next, since for the latter, a new tube is fastened to the extraction head. A contamination-free method for emptying bottles is therefore provided. The replaceable tubes are extremely cost-effective and they are particularly composed of plastic pieces. In general, the tubes can also be made of other materials, such as stainless steel, for example. The use of separate tubes for emptying the bottles therefore does not result in appreciable increase in the manufacturing costs of the removal system.

According to an advantageous embodiment of the invention, the extraction head has locking means that in a locking position secure the tube within the extraction head. By means of the actuation mechanism, the locking means may be moved into a release position, in which they release the tube.

The locking means represent mechanical units that may be moved from the locking position into the release position, or vice versa, by operating the actuation mechanism.

It is especially advantageous for the actuation mechanism to be a purely mechanical unit by means of which actuation movements are generated that may be directly transmitted to the locking means.

As such, a locking and unlocking mechanism of a simple design for the tube is created.

According to an embodiment of the invention that is advantageous from a design perspective, the locking means are formed by balls that are displaceably mounted in bore holes of a guide channel. The tube may be guided inside the guide channel. In the locking position, the balls are pressed against the tube with a pressing force, by means of which the tube is secured in place. In the release position, the balls are released from the tube.

These locking means are implemented in a simple design and ensure reliable locking and unlocking of the tube.

It is especially advantageous for bore holes to be arranged equidistant in the circumferential direction within the guide channel, extending in the radial direction, one ball being guided in every bore hole. The bore holes and balls are respectively identically formed and are oriented in a plane extending perpendicular to the longitudinal axis of the guide channel.

Since the balls for locking the tube within the bore holes are moved in the radial direction and therefore are directly moved toward the tube, there is good transmission of force from the balls onto the tube, and therefore, reliable locking.

Due to the identical form of the bore holes, the balls, and their rotationally symmetrical arrangement within the guide channel, and therefore relative to the tube, even transmission of force onto the tube results on all sides, by means of which especially efficient, reliable locking is achieved.

It is further advantageous for each bore hole, at its opening out into the guide channel, to be constricted to a diameter that is smaller than the diameter of the balls guided in the guide channel.

In this way, the balls are prevented in a straightforward way from falling out of the bore holes when the tube is released out of the guide channel and the guide channel is therefore empty.

According to an advantageous embodiment of the invention, the guide channel is displaceable relative to the locking means.

In general, the guide channel may be a component of a head piece that is displaceable relative to the closing means.

In this embodiment, in a locking position of the closing means, relative to the guide channel, positioning means on the closing means press the locking means in the bore holes against the tube and secure the latter in the guide channel. In a release position of the closing means, relative to the guide channel, the positioning means are out of engagement with the locking means, such that the tube is released from out of the guide channel.

The positioning means are preferably arranged on the closing means. For example, projections, latching stops or latching lugs may be provided as positioning means, which in particular may be components of the closing means and may be formed as a single piece with it. Such positioning means have an especially simple design. Furthermore, by means of such positioning means, an especially simple and direct coupling of the actuation mechanism to the locking means is realized.

In general, the positioning means are controlled by the actuation mechanism. This occurs especially simply such that when the actuation mechanism is not operated by a user, the positioning means provide securing of the tube in the locking position of the closing means. By operating the actuation mechanism, the positioning means are brought out of engagement with the locking means.

It is advantageous for the actuation mechanism to be a spring mechanism. In this case, the head piece is held in the locking position relative to the closing means by the spring force of a spring. Displacement into the release position is done by pressing the head piece onto the closing means against the spring force of the spring.

The functional principle is therefore such that the spring force of the spring provides securing of the tube on the extraction head. To release the tube, a user must operate the actuation mechanism by pressing the head piece against the closing means. Also, in this way, a new tube may be secured on the extraction head.

According to another variant of the invention, the closing means has two parts that can be moved relative to one another into a locking position, in which the tube is fastened to the extraction head, and can be moved relative to one another into a releasing position, in which the tube is released from the extraction head.

An essential advantage of this variant consists in that no separate actuation of actuation means is required to release the tube from the extraction head. Rather, upon opening the closing means in order to release the extraction head from the container, the tube is simultaneously released from the extraction head, such that it can fall into the emptied container.

On the one hand, this represents an efficient structuring of the removal system, since designing separate actuation means can be dispensed with. Furthermore, this improves the functionality and operational reliability of the removal system. An operator no longer has to remember to actuate an actuation mechanism and release the tube from the extraction head. Rather, this occurs automatically and independently upon opening the closing means.

According to an embodiment that is advantageous from a design perspective, the closing means has two parts that can be moved relative to one another into a locking position, in which the tube is fastened to the extraction head, and that can be moved relative to one another into a releasing position, in which the tube is released from the extraction head.

Thereby, when the closing means is opened to release the extraction head from the container, the parts of the closing means are automatically moved into the releasing position.

A releasable fastening of the tube to the extraction head is therefore realized in a straightforward design manner, wherein especially upon opening the closing means the tube is automatically released from the extraction head.

According to an embodiment that is especially simple and robust from a design perspective, the first part of the closing means has engagement elements projecting beyond one of its faces with respectively first guide surfaces. The second part of the closing means has recesses, with second guide surfaces, that open out on one of the faces of the closing means. When moving between the releasing position and the locking position, the first part is moved against the second part by the first guide surfaces being moved along the second guide surfaces.

In the locking position, the faces of the parts closely abut one another. In the releasing position, the parts are separated from one another.

The guide surfaces of the engagement elements and of the recesses ensure low-friction, controlled mobility of the parts of the closing means relative to one another.

It is especially preferable for the closing means to be implemented in a screw top.

In this case, the parts of the closing means are moved into the releasing position when the screw top is screwed off.

The screw top stands out in that it is especially simple to handle.

BRIEF DESCRIPTION OF THE DRAWINGS

The invention is explained below in reference to the drawings. The following is shown.

DETAILED DESCRIPTION OF THE PREFERRED EMBODIMENTS

Figure 1:
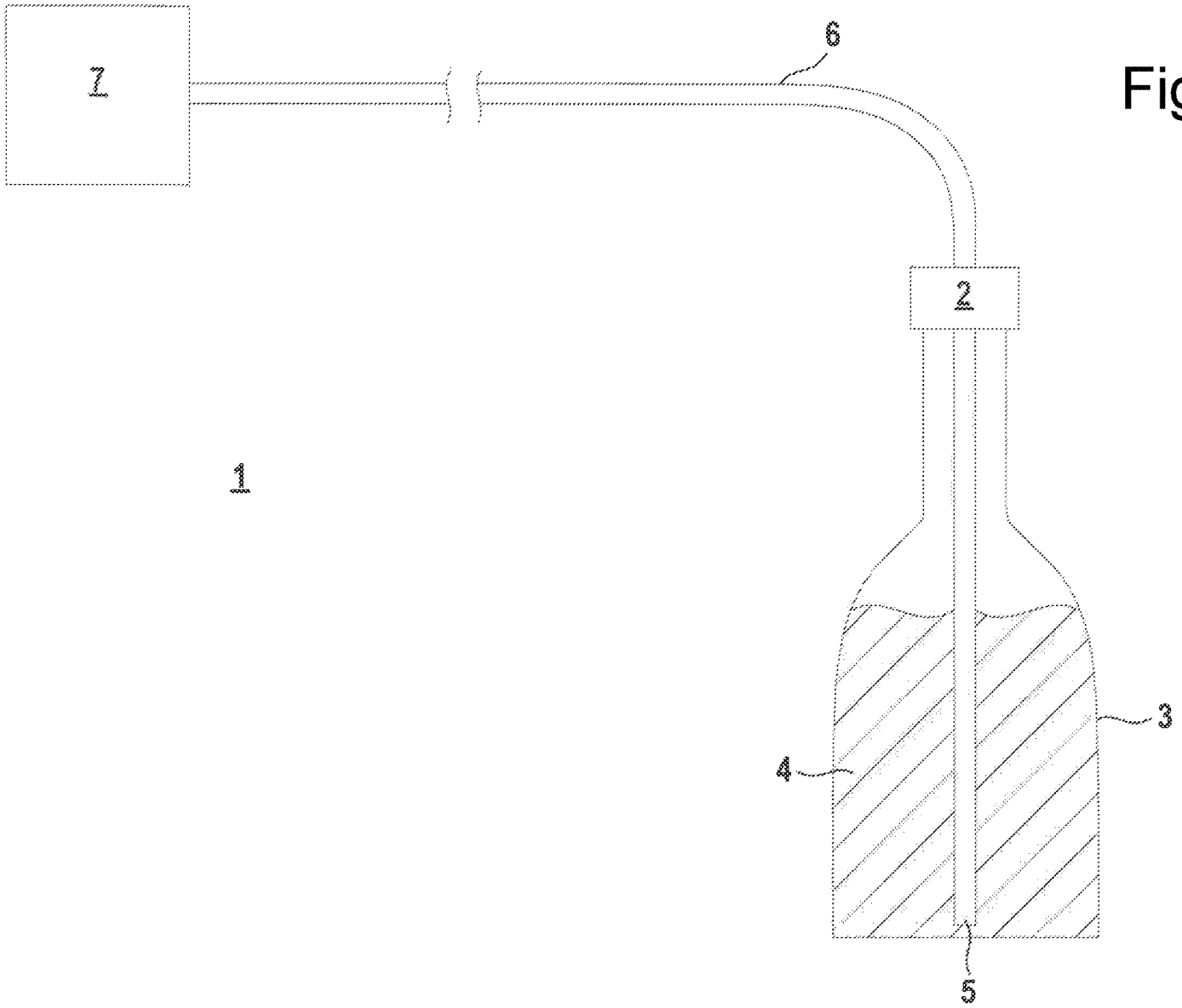
FIG. 1: Schematic representation of a removal system.

FIG. 1 shows schematically an exemplary embodiment of a removal system 1.

The removal system 1 comprises an extraction head 2, that may be placed onto an opening of a bottle 3, which contains a fluid 4. On the extraction head 2, a tube 5 is mounted that runs from the extraction head 2 into the interior cavity of the bottle 3.

The extraction head 2 is further connected to a pump 7 via a line 6. Fluid 4 is pumped out of the bottle 3 by means of the pump 7. The fluid 4 is removed from the bottle 3 via the tube 5 and then fed into the line 6.

Figure 1A:
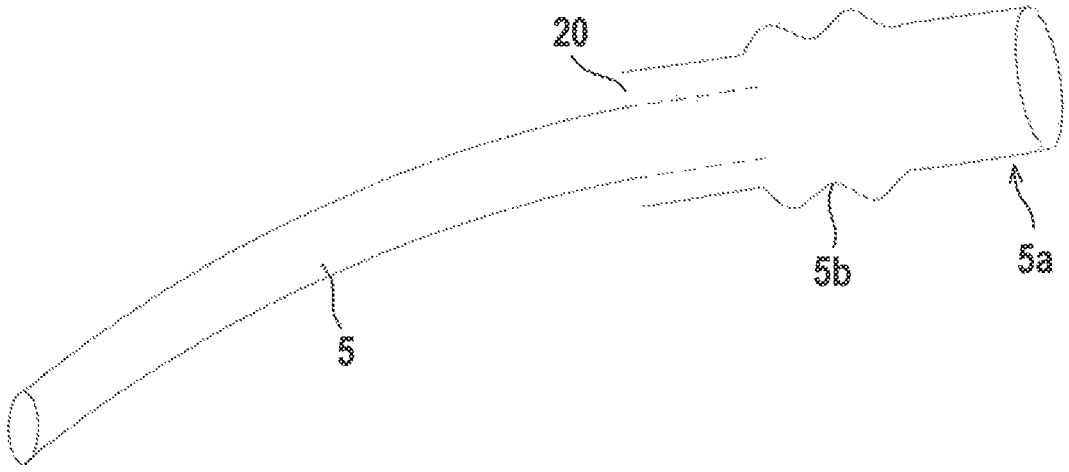
FIG. 1A: Individual representation of the tube according to the invention for the removal system according to FIG. 1.

FIG. 1*a* shows the tube according to FIG. 1. On a longitudinal-side end of the tube 5, an interface 5*a* is actuated for connection 11 to the extraction head 2. The interface 5*a* is designed as a plastic part and has a bore hole 20 extending in the longitudinal direction, with which the interface 5*a* is stuck onto the tube 5. The plastic part forming the interface 5*a* has, at its outer sleeve surface, suitable moldings 5*b* through which adaption to the geometry of the extraction head 2 is achieved. The interface 5*a* is designed for connection 11 to different extraction heads, i.e. removal systems 1.

Figure 2:
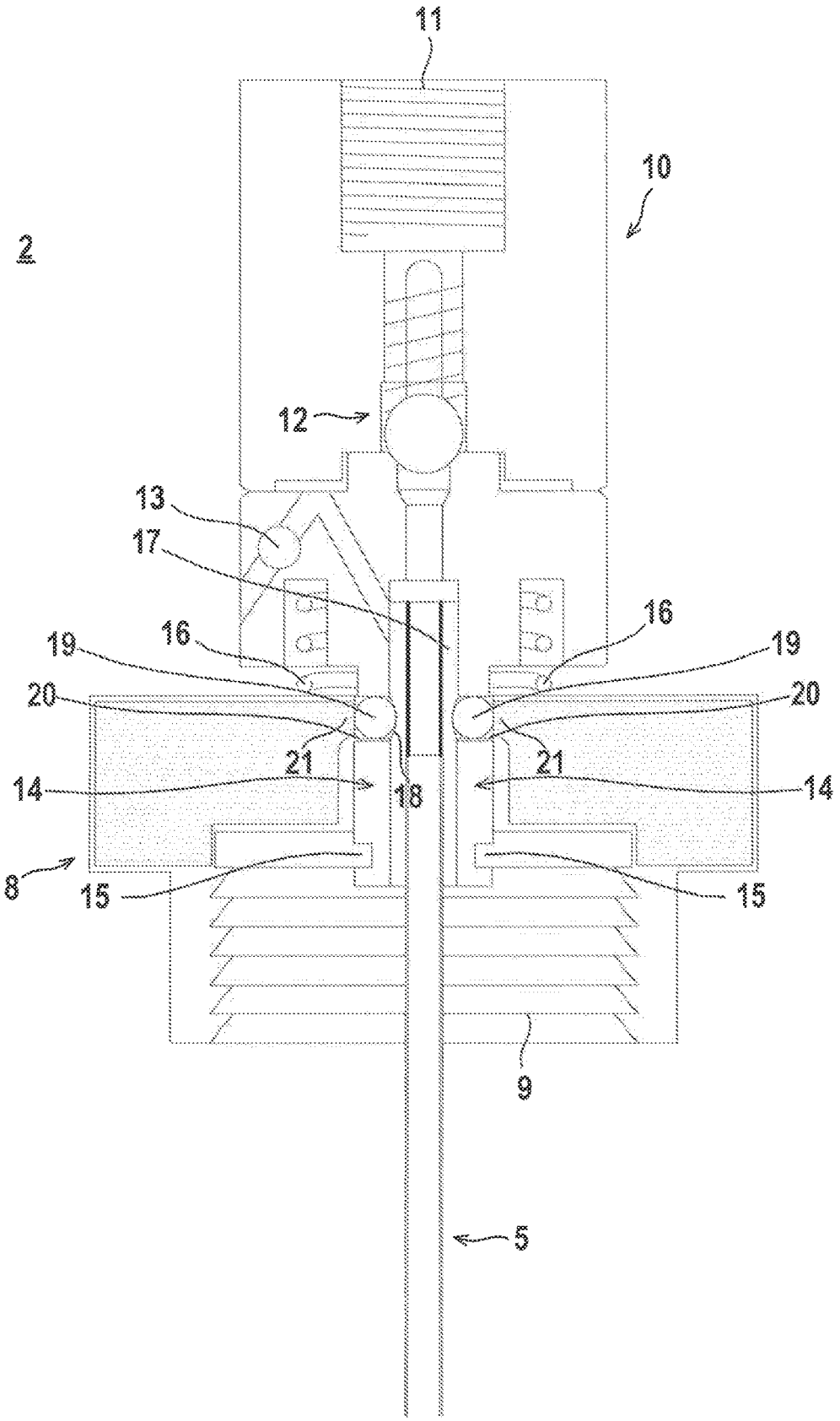
FIG. 2: First example of an extraction head of the removal system according to FIG. 1 with a tube locked therein.
Figure 3:
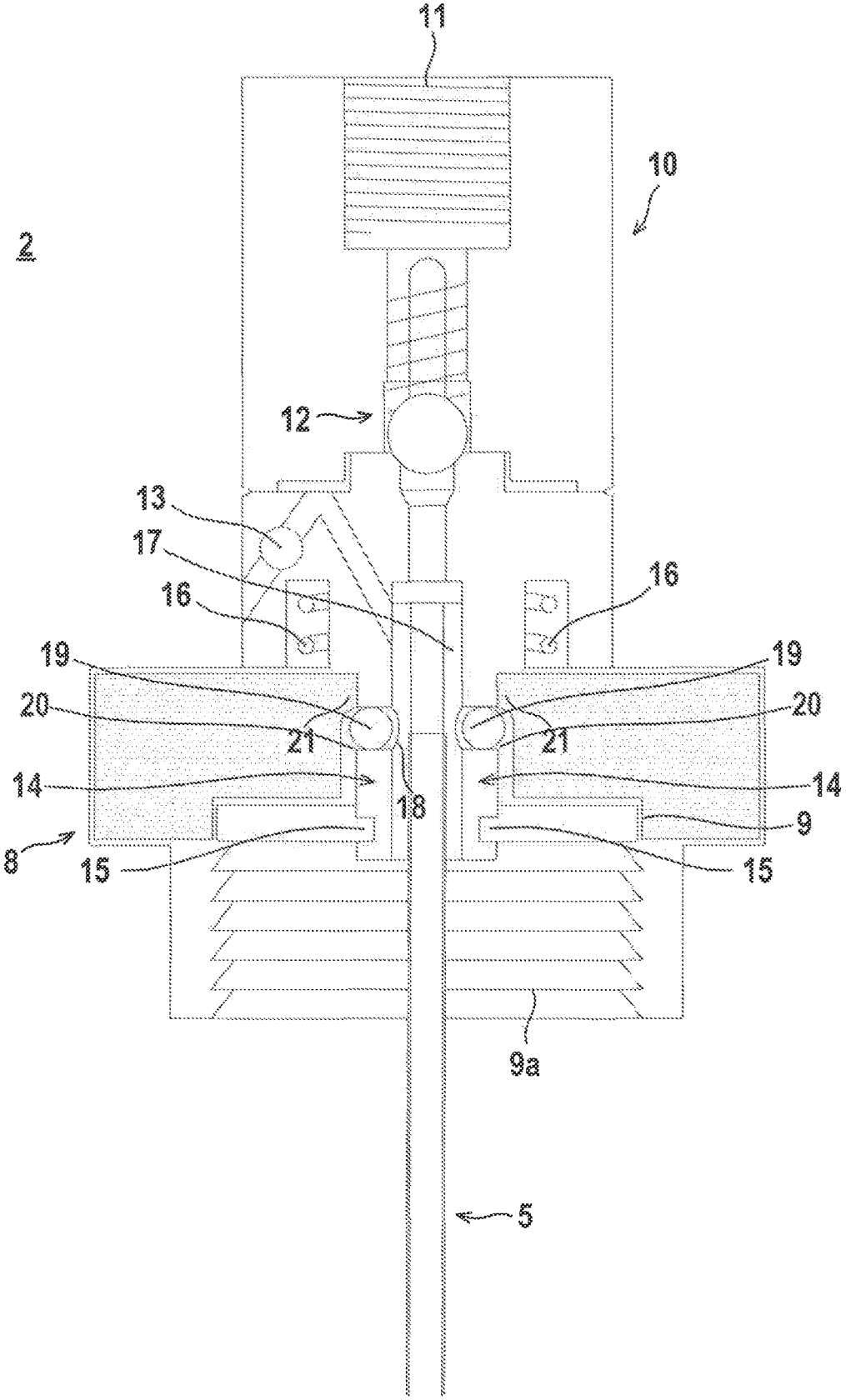
FIG. 3: Extraction head of the removal system according to FIG. 2 with the unlocked tube arranged therein.
Figure 4:
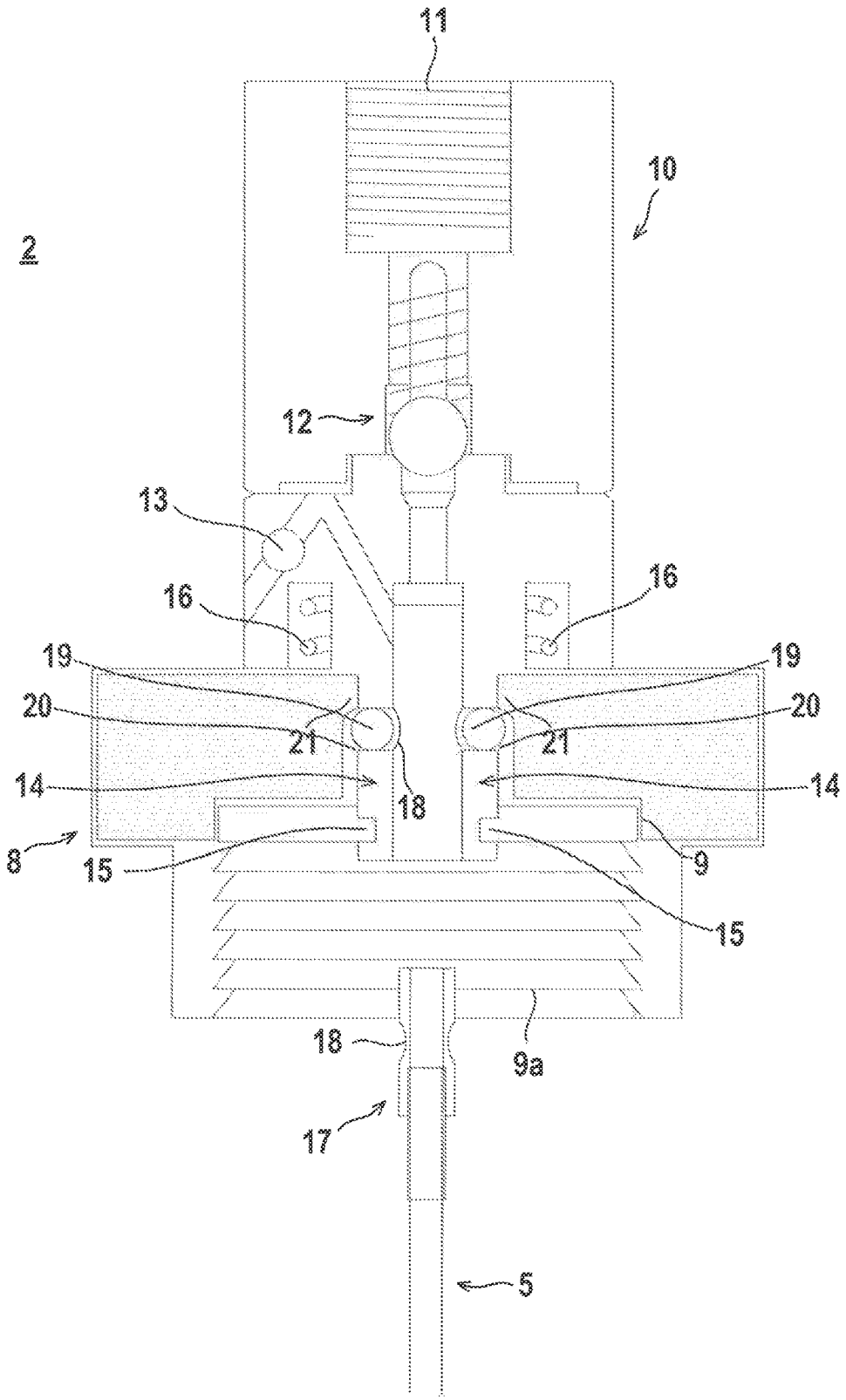
FIG. 4: Extraction head of the removal system according to FIG. 2 with the tube falling out of the extraction head.

FIGS. 2-4 show a first exemplary embodiment of the extraction head 2 according to the invention. The extraction head 2 has a closing means 8 in the form of a screw top, by means of which the extraction head 2 may be secured on the opening of a bottle 3. The screw top has an internal thread 9 that may be screwed onto a thread 9*a* on the opening of the bottle 3. Due to the screw top of the extraction head 2, a leak-tight seal of the opening of the bottle 3 results.

Furthermore, the extraction head 2 has a head piece 10. At the upper end of the head piece 10, a connection 11 is provided at which the line 6 leading to the pump 7 may be connected. The connection 11 is secured by a check valve 12. The check valve 12 prevents fluid 4 from escaping from the line 6. Furthermore, in the head piece 10, a ball valve 13 is provided, by means of which an air and pressure equalization is effected in the bottle 3.

A guide channel 14 opens out at the bottom of the head piece 10, which guide channel 14 projects into a central recess 27 in the closing means 8, wherein the lower end of the guide channel 14 is secured with fastening means 15 within the closing means 8. The guide channel 14 is hollow and cylindrical in form.

The head piece 10 is movable relative to the screw top forming the closing means 8, an actuation mechanism being formed thereby.

A spring 16 is arranged between the head piece 10 and the screw top. The head piece 10 is held at a distance from the top of the locking means 8 by the spring force of the spring 16 (FIG. 2). If a user actuates the actuation mechanism formed in this manner, he presses on the upper end of the head piece 10 and presses it down, until the bottom of the head piece 10 lies on the top of the closing means 8 (FIGS. 3 and 4).

FIG. 2 shows the extraction head 2 with a non-actuated actuation mechanism. The tube 5 is mounted in the inner cavity of the guide channel 14 and held in position there with locking means.

As is evident from FIGS. 2-4, the upper end of the tube 5, which end is insertable into the guide channel 14, is provided with a sleeve 17 forming the interface 5*a*, which sleeve 17 has a molding 5*b* in the shape of a circumferential groove 18 extending in the circumferential direction.

The locking means are formed by balls 19 that are guided in bore holes 20 within the guide channel 14. In the present case, three identical bore holes 20 are provided in a plane perpendicular to the longitudinal axis of the guide channel 14, which bore holes 20 are respectively arranged offset by 120° to one another in circumferential direction. The bore holes 20 extend in radial direction within the guide channel 14. A ball 19 is guided in each bore hole 20, wherein all balls 19 are identical in form. The balls 19 are guided in the respective bore holes 20 with little play.

The diameters of the bore holes 20 are somewhat constricted in the region of the opening out into the guide channel 14, i.e. are somewhat smaller than the ball diameter, such that the balls 19 are prevented from falling out into the empty guide channel 14.

As is evident from FIGS. 2-4, a projection 21 is provided at the upper edge of the wall element of the closing means 8 that delimits the recess 27, which projection 21 runs circumferentially in circumferential direction and represents a narrowing of the recess 27 into which the guide channel 14 projects. This projection 21 forms a positioning means, FIG. 2 showing the closing means 8 and the positioning means in a locking position. This locking position is adopted when the actuation mechanism is not actuated and the spring 16 holds the head piece 10 at a distance from the closing means 8. The projection 21 forming the positioning means then lies, as shown in FIG. 2, in the region of the bore holes 20. The projection therefore pushes the balls in the bore holes in the direction of the interior cavity of the guide channel 14, such that in a locking position, the balls 19 are pressed against the groove 18 in the sleeve 17 of the tube 5 with a pressing force, by means of which the tube 5 is secured within the guide channel 14.

When the actuation mechanism is actuated as shown in FIG. 3, the head piece 10 is pressed against the screw top forming the closing means 8 and the guide channel 14 is pushed further into the recess 27 of the screw top. Thereby, the closing means 8 and with it, the projection 21, are moved from the locking position into a release position. In this release position, the projection 21 lies above the bore holes 20. The balls 19 are therefore in a released position and are therefore no longer pressed against the tube 5 by means of the projection 21, i.e. the tube 5 is no longer held securely inside the guide channel 14. Therefore, due to gravity, the tube 5 falls out of the guide channel 14 (FIG. 4) and falls into the bottle 3.

To empty the bottle 3, the extraction head 2 is fastened to the bottle 3. The actuation mechanism is not actuated and the tube 5 is held securely inside the guide channel 14 (FIG. 2). The bottle 3 is then emptied by means of the pump 7. Once the bottle 3 is empty, the actuation mechanism is actuated and the tube 5 inside the guide channel 14 is released (FIG. 3), such that the tube 5 falls into the empty bottle 3 and may be disposed of.

If the extraction head 2 is to be used for removing fluid 4 from another bottle 3, first a new tube 5 is fastened inside the guide channel 14 of the extraction head 2. To do so, a user actuates the actuation mechanism and then slides the tube 5 into the guide channel 14. Then the user releases the head piece 10, such that the head piece 10 is raised up from the closing means 8 by the spring force of the spring 16. The closing means 8, with its projection 21, is thereby moved into the locking position, by means of which the tube 5 is held securely inside the guide channel 14.

The assembly formed in this manner may then be placed onto the other bottle 3 for removing fluid 4.

Figure 5:
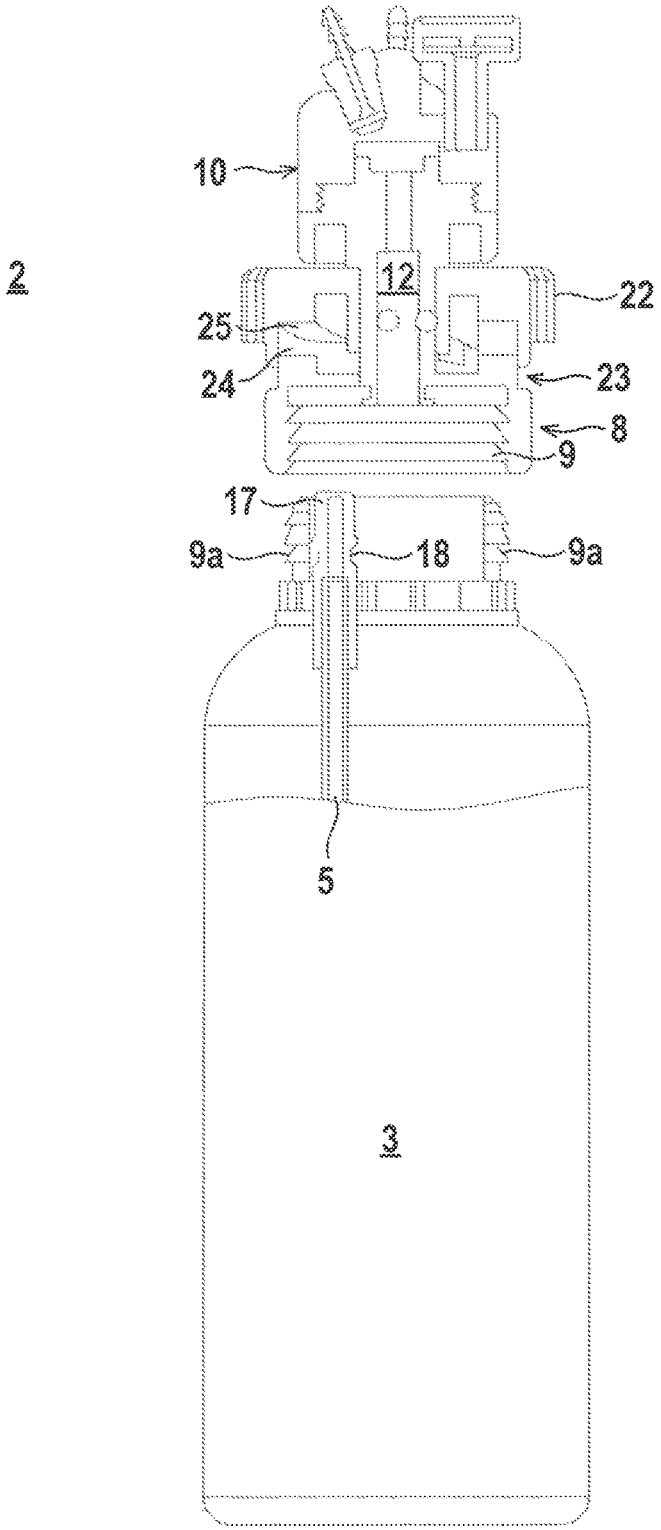
FIG. 5: Second example of an extraction head of the removal system according to FIG. 1.

FIG. 5 shows a second exemplary embodiment of the extraction head 2 of the removal system 1. In this case as well, for removing fluid 4, the tube 5 with the sleeve 17 for removing fluid 4 is used as a single-use part, i.e. a disposable part.

In this case, the tube 5 is coupled to the screw top forming the closing means 8, such that with the screw top, the tube 5 can be releasably fastened to the extraction head 2. In particular, the tube 5 is released automatically from the extraction head 2 when the screw top is screwed open.

Figure 6:
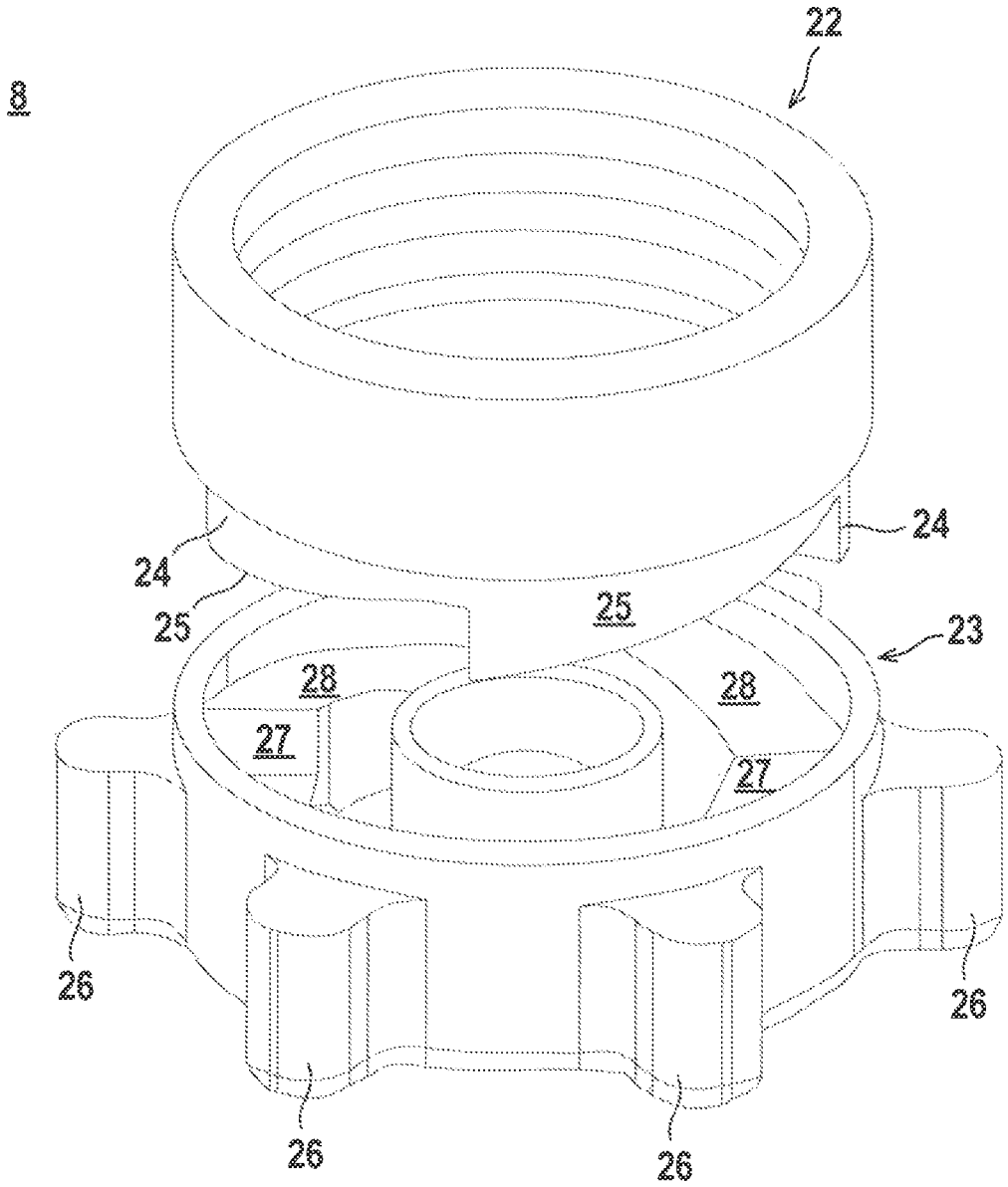
FIG. 6: Individual representation of the components of the closing means of the extraction head according to FIG. 5.

As shown in FIG. 5 and especially the individual representation of the closing means 8 in FIG. 6, the latter has two parts 22, 23 that are movable relative to one another.

Both parts have main bodies that essentially have rotational symmetry.

The first part 22 is essentially designed as a hollow cylinder. Multiple identically formed engagement elements 24, that respectively have a curved shape forming a first guide surface 25, project from the edge on one face.

The second part 23 has projections 26 that open out on its outer jacket surface, which projections 26 serve the manual actuation of the screw top. Within the main body of the first part 22, recesses 27 opening out on a face are provided, wherein each recess 27 has a second guide surface 28 corresponding, i.e., designed with a complementary shape, to the respective first guide surface 25 of an engagement element 24.

The first and second part 22, 23 are rotated on top of one another to form the closing means 8, such that the first guide surfaces 25 of the engagement elements 24 are in contact with the second guide surfaces 28 of the recess 27. In this way, the parts of the closing means 8 can be moved between a locking position and a releasing position.

In the locking position, the first guide surfaces 25 of the engagement elements 24 lie with their full area on top of the second guide surfaces 28 of the recesses 27, such that the faces of the first and second part 22, 23 tightly abut one another, as shown in FIG. 5.

In this locking position, the tube 5 abutting the inner side of the thread 9*a* is fastened with a sleeve 17 on the extraction head 2.

When the screw top is screwed open, the parts 22, 23 are separated from one another by the first guide surfaces 25 sliding along the second guide surface 28. Once the screw top is screwed open to such an extent that the parts 22, 23 are in their releasing position, the tube 5 is released and it falls into the bottle 3.

LIST OF REFERENCE NUMERALS (1) Removal system
(2) Extraction head
(3) Bottle
(4) Fluid
(5) Tube
(5*a*) Interface
(5*b*) Molding
(6) Line
(7) Pump
(8) Closing means
(9) Internal thread
(9*a*) Threads
(10) Head piece
(11) Connector
(12) Check valve
(13) Ball valve
(14) Guide channel
(15) Fastening means
(16) Spring
(17) Sleeve
(18) Groove
(19) Ball
(20) Bore hole
(21) Projection
(22) First part
(23) Second part
(24) Engagement element
(25) First guide surface
(26) Projection
(27) Recess
(28) Second guide surface

The invention claimed is:

1. A tube (5) for a removal system (1) with an extraction head (2) configured to be fastened to a container via closing means (8), characterized in that the tube (5) has an interface (5*a*) for releasable connection to the extraction head (2), wherein the interface (5*a*) is configured such that the tube (5) is released from the extraction head (2) when the closing means are opened to release the extraction head (2) from the container, and the tube (5) falls into the container and thereby forms a single-use part.

2. The tube (5) according to claim 1, characterized in that the interface (5*a*) is designed for connection (11) to different extraction heads.

3. The tube (5) according to claim 1, characterized in that the interface (5*a*) is formed by a plastic part fastened to the tube (5).

4. The tube according to claim 1, characterized in that the closing means (8) is inside a screw top.

* * * * *